US007559281B2

(12) United States Patent
Huard et al.

(10) Patent No.: US 7,559,281 B2
(45) Date of Patent: Jul. 14, 2009

(54) TRANSPORT INSTALLATION WITH AERIAL ROPE CONVEYING CHAIRS AND GONDOLA CARS

(75) Inventors: Jean-Paul Huard, Saint Jorioz (FR); Nicolas Revenant, Echirolles (FR)

(73) Assignee: Pomagalski SA, Fontaine (FR)

( * ) Notice: Subject to any disclaimer, the term of this patent is extended or adjusted under 35 U.S.C. 154(b) by 213 days.

(21) Appl. No.: 11/723,731

(22) Filed: Mar. 21, 2007

(65) Prior Publication Data

US 2007/0283840 A1 Dec. 13, 2007

(30) Foreign Application Priority Data

Apr. 10, 2006 (FR) ..... 06 03153

(51) Int. Cl.
*B61B 12/00* (2006.01)

(52) U.S. Cl. ..... 104/173.1; 104/173.2; 104/178

(58) Field of Classification Search ..... 104/173.1, 104/178, 179, 28, 117.1, 205, 252, 173.2, 104/27

See application file for complete search history.

(56) References Cited

U.S. PATENT DOCUMENTS 2,116,226 A * 5/1938 Vogel ..... 104/180
4,473,011 A * 9/1984 Wuschek ..... 104/173.1
4,627,361 A * 12/1986 Tarassoff ..... 104/28
4,669,389 A * 6/1987 Tarassoff ..... 104/173.2
4,699,064 A * 10/1987 Tarassoff ..... 104/163
4,712,486 A * 12/1987 Tarassoff ..... 104/173.1
4,744,306 A * 5/1988 Kunczynski ..... 104/168
4,794,864 A * 1/1989 Feuz et al. ..... 104/168
4,843,968 A * 7/1989 Rikli ..... 104/27
4,843,970 A * 7/1989 Feuz ..... 104/27
5,105,745 A * 4/1992 Tarassoff ..... 104/179
5,111,751 A * 5/1992 Zlotek ..... 104/209
5,562,040 A * 10/1996 Egli ..... 104/173.1
5,626,078 A * 5/1997 Fuchs ..... 104/28
5,873,310 A * 2/1999 Creissels et al. ..... 104/173.2
6,202,563 B1 * 3/2001 Tarassoff et al. ..... 104/28
6,729,241 B2 * 5/2004 Gabriel et al. ..... 104/173.1

(Continued)

FOREIGN PATENT DOCUMENTS

AT 006 736 U2 3/2004

(Continued)

*Primary Examiner*—S. Joseph Morano
*Assistant Examiner*—Jason C Smith
(74) *Attorney, Agent, or Firm*—Oliff & Berridge, PLC

(57) ABSTRACT

A transport installation with a continuous running aerial rope supports chairs and gondola cars coupled by detachable grips. The rope extends in a closed loop between two bull-wheels, with an up-line and a down-line. The installation presents loading/unloading terminals provided at least at the ends of said lines. One of the terminals comprises a transfer circuit connecting the up-line and the down-line, with a slowing-down section equipped with a slowing-down device, a speeding-up section equipped with a propelling device, connected by a run-through section with a low running speed equipped with a driving device of the vehicles. The transfer circuit comprises a continuous running speed regulating section equipped with a speed regulating means that is able to vary the time required by the cars and the chairs to pass through the speed regulating section, to impose a first predetermined running speed of the cars and a second predetermined running speed of the chairs.

12 Claims, 3 Drawing Sheets

U.S. PATENT DOCUMENTS

| | | | | |
|---|---|---|---|---|
| 7,004,077 | B2 * | 2/2006 | Meindl | 104/173.1 |
| 2004/0011240 | A1 * | 1/2004 | Gabriel et al. | 104/173.1 |
| 2005/0081738 | A1 * | 4/2005 | Meindl | 104/173.1 |
| 2006/0252562 | A1 * | 11/2006 | Anderson et al. | 472/32 |
| 2007/0034105 | A1 * | 2/2007 | Mugnier | 104/178 |
| 2007/0283840 | A1 * | 12/2007 | Huard et al. | 104/202 |

FOREIGN PATENT DOCUMENTS

| | | | |
|---|---|---|---|
| EP | 0 114 129 | A1 | 7/1984 |
| EP | 0 461 954 | A1 | 12/1991 |
| EP | 1752352 | A2 * | 2/2007 |

* cited by examiner

TRANSPORT INSTALLATION WITH AERIAL ROPE CONVEYING CHAIRS AND GONDOLA CARS

BACKGROUND OF THE INVENTION

The invention relates to a transport installation with a continuous running aerial rope, supporting vehicles composed of chairs and gondola cars coupled by detachable grips and staggered along the rope in a predetermined combination and with a predetermined running rate, said rope extending in a closed loop between two bull-wheels, with an up-line and a down-line, said installation having loading/unloading terminals provided at least at the ends of said lines, at least one of the loading/unloading terminals comprising:

- detachment means, on entry, to detach the grips from the rope,
- engagement means, on exit, to recouple the grips and the rope,
- a transfer circuit connecting the up-line and the down-line of the rope, with a slowing-down section equipped with a slowing-down device, and a speeding-up section equipped with a propelling device, connected by a run-through section with a low running speed equipped with a driving device of the vehicles,
- a first location for loading/unloading into/from the cars and a second location for loading on or unloading from the chairs, staggered along the transfer circuit,
- and a continuous running rate regulating section arranged in the transfer circuit to perform said regulation of the vehicles.

STATE OF THE ART

This type of installation is already known and enables the requirements of two types of users to be met at the same time. The chairs are designed to carry skiers whereas the cars transport pedestrians, children or other persons with reduced mobility. In parallel, the safety and comfort are enhanced for these two types of users by the suitability of the vehicle to meet the requirements of each type of user.

In this type of installation, the vehicles entering a loading/unloading terminal, whether they be of the chair type or of the car type, are slowed down along the slowing-down section by means of the slowing-down device, after the grips supporting the vehicles have been detached from the aerial rope. The vehicles then run at low speed along the run-through section, driven by a driving device generally equipped with tire-clad wheels. On exit from the run-through section, the vehicles are taken up in the speeding-up section by a propelling device in order to reach a speed corresponding to the running speed of the rope. On exit from the speeding-up section, the vehicles are recoupled to the rope by the grips engaging on the rope.

Conventionally, a bottom terminal is equipped with a first location for loading/unloading in/from the cars and a second location for loading on the chairs arranged along the transfer circuit in the direction of movement of the vehicles. The driving speed along the location for loading/unloading in/from the cars is very slow, about 0.25 m/s, whereas this driving speed is increased along the location for loading on the chairs until it reaches about 1 m/s. The running speed of the aerial rope is for its part about 5 m/s, which guarantees a high throughput of the installation. A top terminal presents a reverse configuration with a location for unloading the chairs followed by a location for loading/unloading in/from the cars, these two locations being staggered along the transfer circuit in the direction of movement of the vehicles.

The vehicles, either chairs or cars, are arranged along the rope in a predetermined combination and with a predetermined rate. In operation, this combination remains identical in the loading/unloading terminals, for the vehicles all run on a single track. The rate of running is chosen such that the vehicles present an equal time interval between one another. This time interval is identical in the terminals and along the rope. As the running speed of the rope is considerably greater than the driving speed of the vehicles in the terminals, the latter are much closer to one another in the terminals than along the rope. The minimum value of the time interval between two vehicles is conditioned by the physical distance necessary between these two vehicles to prevent them from bumping into one another in the curve of the slowest part of the run-through section, which would be dangerous for people outside the vehicles and uncomfortable for the users on board. For example, the minimum time interval is 8.7 s for a minimum driving speed of 0.25 m/s.

For this purpose, it is known to provide a rate regulating section along the transfer circuit of at least one of the terminals, but which imposes on exit therefrom a regular running rate of the cars and chairs regardless of their frequency of entry. This rate regulating section enables the inevitable deviations which occur during operation to be avoided, and the installation can operate under optimum conditions, i.e. with a high and regular throughput.

But these known installations are not completely satisfactory as far as the user throughput is concerned. Indeed, the maximum value of this throughput is in fact linked to the minimum value of the time interval between two successive vehicles in the terminal. The minimum value of the time interval does however result from a compromise that is chosen such as to be long enough to take account of the larger space occupation of a car with respect to that of a chair. In practice, the minimum value of the time interval between successive vehicles is established according to the physical distance required between a chair and a car to prevent the latter from bumping into one another in the curve of the slowest part of the run-through section. In addition, it is impossible to configure the installation in such a way as to have two successive cars without this considerably reducing the user throughput for, in this case, the time interval between vehicles is increased. The diversity of combination of the vehicles is therefore very limited if a correct user throughput is to be preserved.

OBJECT OF THE INVENTION

The object of the invention is to remedy the above shortcomings by proposing an aerial ropeway transport installation of the type mentioned in the preamble of the main claim which achieves an increased user throughput and which improves the diversity of combination of the vehicles.

According to the invention, this object is achieved by the fact that the rate regulating section is equipped with a rate regulating means able to vary the time spent by the cars and by the chairs in said rate regulating section so as to impose a first predetermined running rate of the cars and a second predetermined running rate of the chairs.

This arrangement enables the time interval between two successive vehicles of the same type to be adapted according to the physical distance necessary between two vehicles of the same type to prevent them from bumping into one another in the curve of the slowest part of the run-through section. It thereby becomes possible to provide groups of successive cars without this considerably reducing the user throughput. The cars are farther apart from one another whereas the chairs are closer to one another in comparison with the constant speed regulation of the prior art which resulted from a compromise.

According to a development of the invention, the rate regulating section imposes a third predetermined running rate on a vehicle passing through said rate regulating section when the previous vehicle, seen in the direction of movement, is of a different type from said vehicle, the third predetermined running rate being comprised between the first and second predetermined running rates. The time interval between a chair and a car is therefore optimized to prevent them from bumping into one another in the curve of the slowest part of the run-through section.

A rate regulating section according to the invention therefore has the object of optimizing the time interval between two successive vehicles according to the physical distance just necessary between these two vehicles, depending on their respective type, to prevent them from bumping into one another in the curve of the slowest part of the run-through section.

BRIEF DESCRIPTION OF THE DRAWINGS

Other advantages and features will become more clearly apparent from the following description of particular embodiments of the invention given as non-restrictive examples only and represented in the accompanying drawings, in which.

DESCRIPTION OF PARTICULAR EMBODIMENTS

Figure 1:
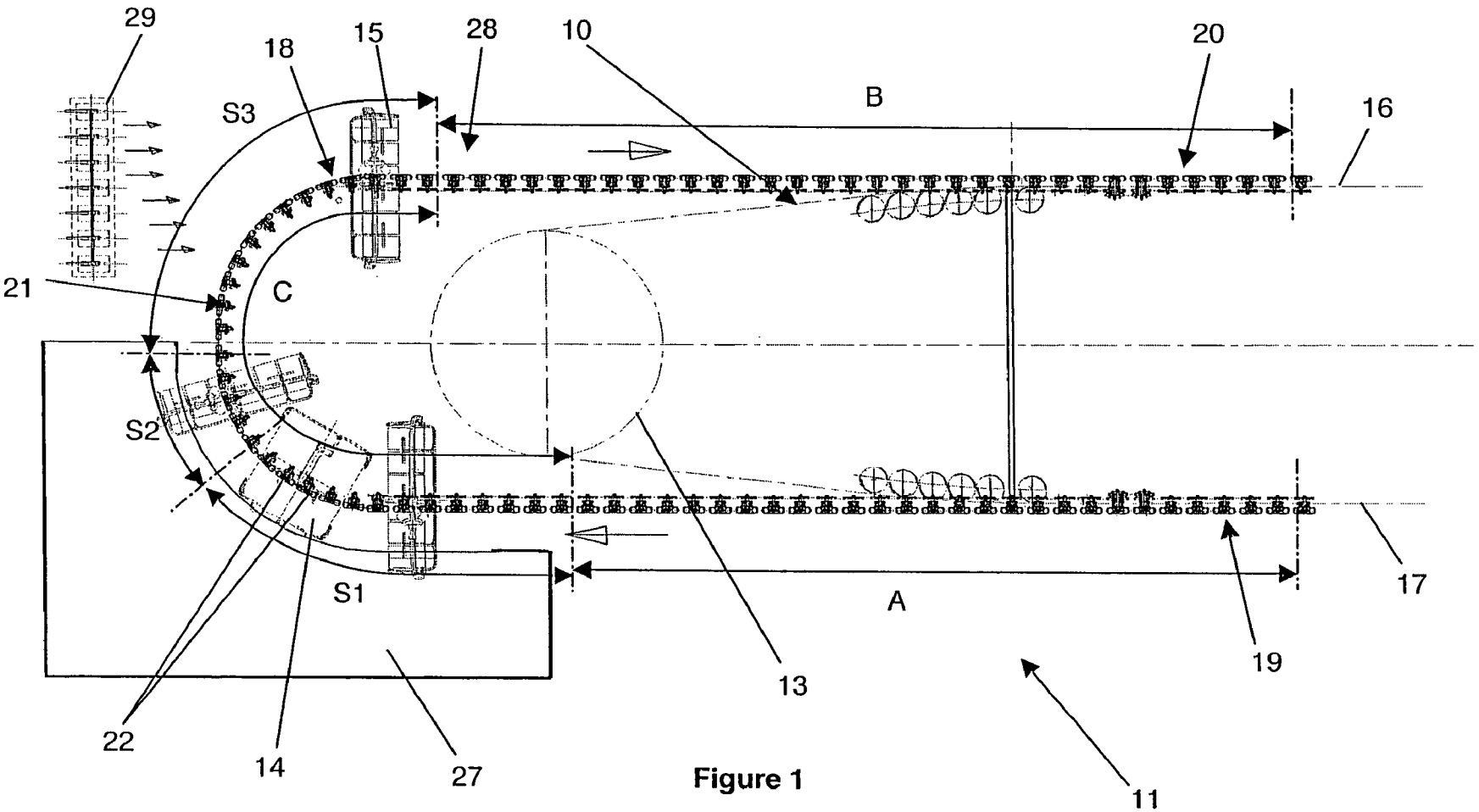
FIG. 1 is a schematic top view of a bottom terminal of an example of an installation according to the invention.

In the figures, an aerial rope 10 of a transport installation extends in a closed loop between two loading/unloading terminals 11, 12, respectively bottom and top terminals, passing in the terminals on bull-wheels 13, one whereof, the drive bull-wheel, drives the rope 10 continuously. The rope 10 supports gondola cars 14 and chairs 15 coupled by detachable grips staggered along the rope in a predetermined combination. The transport installation can comprise other intermediate terminals located along the up-line 16 and the down-line 17 of the rope 10 for loading and/or unloading passengers to and from the vehicles 14, 15.

Figure 2:
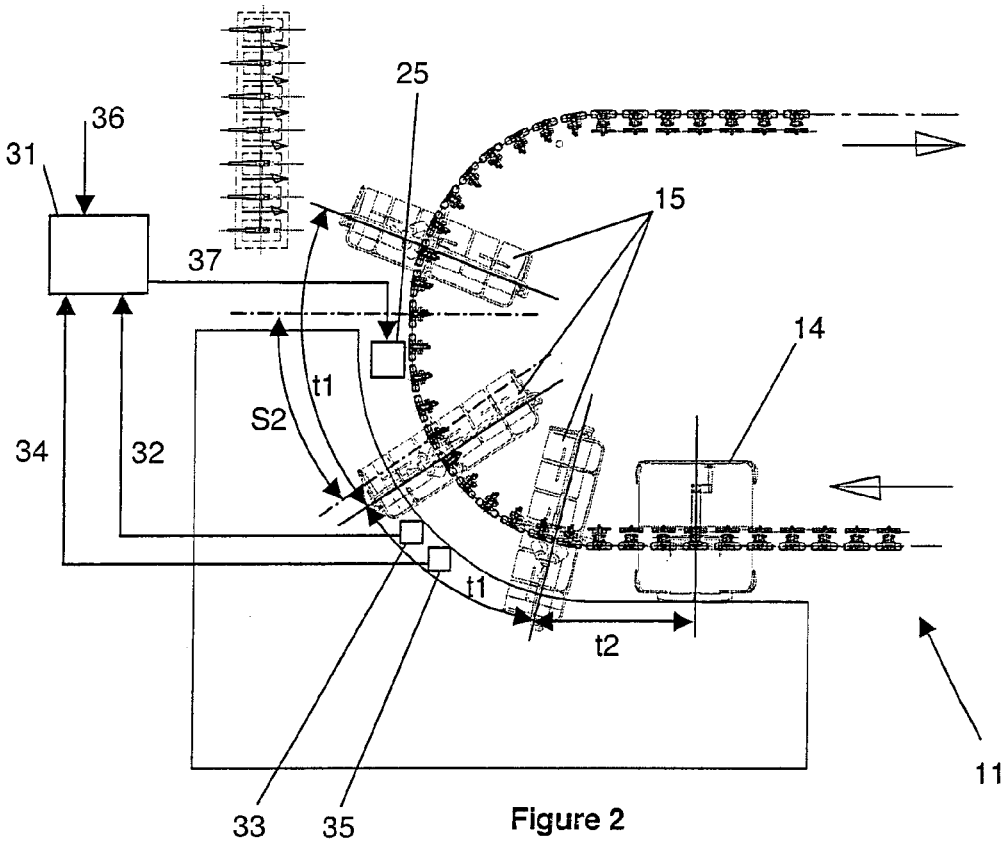
FIG. 2 is a second schematic view of the bottom terminal of FIG. 1 where the vehicles are different.

FIGS. 1 and 2 illustrate the bottom terminal 11. At the entry to the terminal 11, the vehicles are detached from the down-line 17 and run on a transfer circuit 18 at reduced speed in the terminal 12 until they reach the up-line 16. A slowing-down device 19 slows down the vehicles 14, 15 detached from the rope 10, whereas at the exit a propelling device 20 re-accelerates them to a speed equal to that of the rope to enable them to be recoupled to the rope 10 without jerking. The slowing-down device 19 and propelling device 20 are both formed by a set of tire-clad wheels staggered along a portion of the transfer circuit 18, respectively a slowing-down section A and a speeding-up section B, so as to operate by friction in conjunction with a friction track supported by the grips of the vehicles 14, 15. The wheels of the slowing-down device 19 and of the speeding-up device 20 are coupled by means of belts engaged on auxiliary pulleys fitted coaxially to the wheels. Each wheel is fixedly secured to two auxiliary pulleys, each respectively operating in conjunction with a belt, one of the belts engaging on one of the auxiliary pulleys of one of the adjacent wheels and the other of the belts operating in conjunction with one of the auxiliary pulleys of the other of the adjacent wheels. For driving, at least one of the wheels of each of the devices 19 and 20 can be connected by means of a belt to a driving power take-off branched-off from the rope 10 or the bull-wheel 13. Such devices are well-known and do not need to be described in greater detail here.

Figure 4:
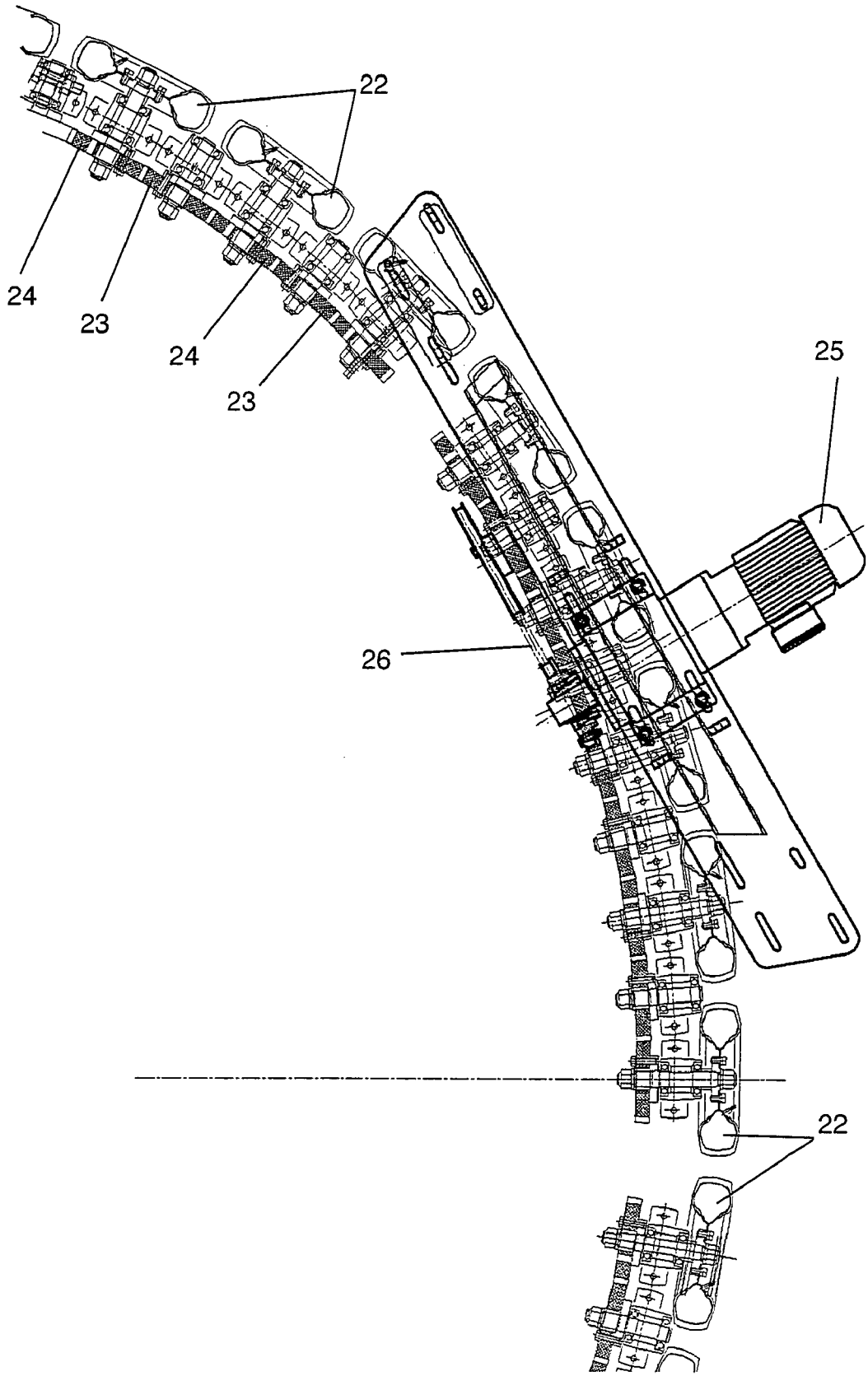
FIG. 4 is a partial view of the run-through section of the bottom terminal of FIGS. 1 and 2 showing details of an example of the rate regulating section according to the invention.

The slowing-down section A and speeding-up section B are connected by a run-through section C along which the vehicles 14, 15 run in continuous manner at reduced speed by means of a driving device 21 formed by sets of tire-clad wheels 22. The driving device 21 of the run-through section C is subdivided into three successive portions each delineating an elemental section S1, S2, S3 and able to have differential driving speeds. The wheels 22 of the semi-circular part of the run-through section C, within any one portion, are driven in synchronism with one another by idler pinions 23 (FIG. 4) intercalated between transmission pinions 24 mounted coaxially with the wheels 22. The rest of the wheels 22 of the run-through section C, in the straight portion of either section S1 or S3, are driven together in the same way as the wheels of the slowing-down device 19 and speeding-up device 20. The portion which delineates the section S2 is comprised of five wheels 22 and separated from the other two portions by removal of an idler pinion 23. One of the wheels 22 of the portion delineating the section S1 is driven in rotation by one of the wheels of the slowing-down section A. In like manner, one of the wheels 22 of the portion delineating the section S3 is driven in rotation by one of the wheels of the speeding-up section B. To drive the five wheels 22 of the portion delineating the section S2, a variable-speed motor 25 (FIG. 4) drives a transmission belt 26 stretched between two pulleys one whereof is mounted coaxially with one of the idler pinions 23.

In the bottom loading/unloading terminal 11, a loading/unloading platform 27 for loading in and unloading from the gondola cars 14 is arranged along the sections S1 and S2. The speed of movement of the vehicles 14, 15 in the sections S1 and S2 is very low, for example about 0.25 m/s. A loading location 28 on the chairs 15 is further arranged in coincident manner with the area covered by the chairs 15 along the section S3 to allow skiers entering via an access gate 29 to sit down on the chairs 15. The speed of movement of the vehicles 14, 15 when passing the loading location 28 is about 1 m/s. To reach this speed, the vehicles 14, 15 are accelerated in identical manner on the section S3 as soon as they have left the section S2.

In opposite manner, the vehicles 14, 15 running in the top loading/unloading terminal 12 (FIG. 3) first encounter an unloading location 30 of the chairs 15 then run alongside a loading/unloading platform 27 for loading in and unloading from the cars, these two locations 27, 30 being staggered along the transfer circuit of the top terminal 12 in the direction of movement of the vehicles 14, 15.

With reference to FIG. 2, the motor 25 that performs driving of the five wheels 22 of the portion delineating the section S2 is controlled by a control unit 31, for example a controller, which can perform other functions, in particular that of control and monitoring of any installation. The control unit 31 receives a passage signal 32 representative of passing of the vehicles 14, 15, supplied by a presence sensor 33 arranged along the section S1 and providing a pulse each time a vehicle 14, 15 passes. It also receives a selection signal 34 from a detection means 35 provided upline from the section S2, arranged at a specific location between the slowing-down section A and the section S2, and able to determine the type of vehicle 14, 15 entering an associated zone, i.e. enabling recognition of a chair 15 or of a gondola car 14. The control unit 31 also receives a clock signal 36 emitted by a detector (not shown) operating in conjunction with the bull-wheel 13 and emitting pulses synchronized with the running of the rope 10. The output of the control unit 31 delivers a control signal 37 to the motor 25 so as to ensure suitable control of the motor 25 for a predetermined regulation of the rate of the vehicles 14, 15 on exit from the section S2, in the manner which will be described further on. The section S2 is hereinafter called the rate regulating section S2.

The rate regulating section S2 according to the invention operates in the following manner: a vehicle, whether it be a gondola car 14 or a chair 15, entering the bottom terminal 11 is detached from the aerial rope 10 and runs along the transfer circuit 18 being propelled by the tire-clad wheels of the sections A, C, and then B. The wheels of the slowing-down section A slow the vehicle 14, 15 down, whereas the following wheels 22 of the section S1 move along the platform 27 until they reach the detection means 35 arranged along the section S1 at the entry to the rate regulating section S2. Passing of the vehicle 14, 15 in the detection zone associated with the detection means 35 generates a selection signal 34 which is transmitted to the control unit 31. The latter further comprises a memory for recording the selection signals 34. From this data, the control unit 31 determines the type of vehicle 14, 15 that is about to enter the rate regulating section S2 and also the type of the previous vehicle 15, 15, seen in the direction of movement, which has partially or completely passed through the rate regulating section S2. The control unit 31 uses this data to determine the theoretical time interval that ought to separate the vehicle 14, 15 about to enter the rate regulating section S2 and the previous vehicle 14, 15 when leaving the rate regulating section S2. The theoretical time interval separating two successive vehicles 14, 15 at the exit from the rate regulating section S2 is such that the physical distance between these two vehicles corresponds to the distance required, according to their respective type, to prevent them from bumping into one another in the curve of the slowest part of the run-through section C. The distances required between two successive vehicles 14, 15, depending on their respective type, are pre-recorded in the control unit 31. Thus, to establish the theoretical time interval, the control unit 31 determines the drive speeds procured by the driving device 21 along the sections S1 and S2, i.e. at the places where the driving speed is lower and where the vehicles 14, are in a curve. The relations establishing the theoretical time intervals according to the driving speeds are pre-recorded in the control unit 31. The driving speeds are determined by the control unit 31 from the clock signal 36.

The vehicle 14, 15 then passes in front of the presence sensor 33 which sends a passage signal 32 to the control unit 32, generally in the form of a pulse, which control unit incorporates a means for counting the time elapsed between two successive passage signals 32. The control unit 31 therefore establishes the actual time interval that separated said vehicle 14, 15 and the previous vehicle 14, 15 before said previous vehicle 14, 15 passes through the rate regulating section S2.

By comparison between the theoretical time interval and the actual time interval measured, the control unit 31 is able to detect any deviation due to inevitable staggers liable to occur during operation (different braking and acceleration conditions from one vehicle 14, 15 to the other, variable loading of the vehicles 14, 15, variable climatic conditions, etc.). The deviation is determined before the vehicle 14, 15 reaches the rate regulating section S2.

Then, when the vehicle 14, 15 runs through the rate regulating section S2, the control unit 31 uses a suitable control signal 37 to perform speed control of the variable speed motor 25 in such a way that the time the vehicle 14, 15 takes to pass through the section is modulated to compensate for the deviation determined above.

Consequently, the rate regulating section S2 is equipped with a rate regulating means formed by the control unit 31, the presence sensor 33, the detection means 35, the variable speed motor 25, and the detector delivering the clock signal 36. According to the invention, the above rate regulating means are able to vary the time spent in the rate regulating section S2 by the cars 14 and by the chairs 15 to impose a differential speed with a first predetermined rate of running of the cars 14 and a second predetermined rate of running of the chairs 15. Moreover, the rate regulating section S2 imposes a third predetermined rate of running on a vehicle 14, 15 passing through said rate regulating section S2 when the previous vehicle 14, 15 is of a different type from said vehicle 14, 15, the third predetermined rate being comprised between the first and second predetermined rates. The first, second and third predetermined rates correspond to a time interval between a vehicle 14, 15 leaving the rate regulating section S2 and the previous vehicle, seen in the direction of movement. At each passage of a vehicle 14, 15, the time interval to be obtained on exit from the rate regulating section S2 with respect to the previous vehicle is determined by the control unit 31 before said vehicle reaches the rate regulating section S2 according to the type of said vehicle and of the type of said previous vehicle. The predetermined rates are modulated according to the speed of the aerial rope 10 by means of the clock signal 36.

Figure 3:
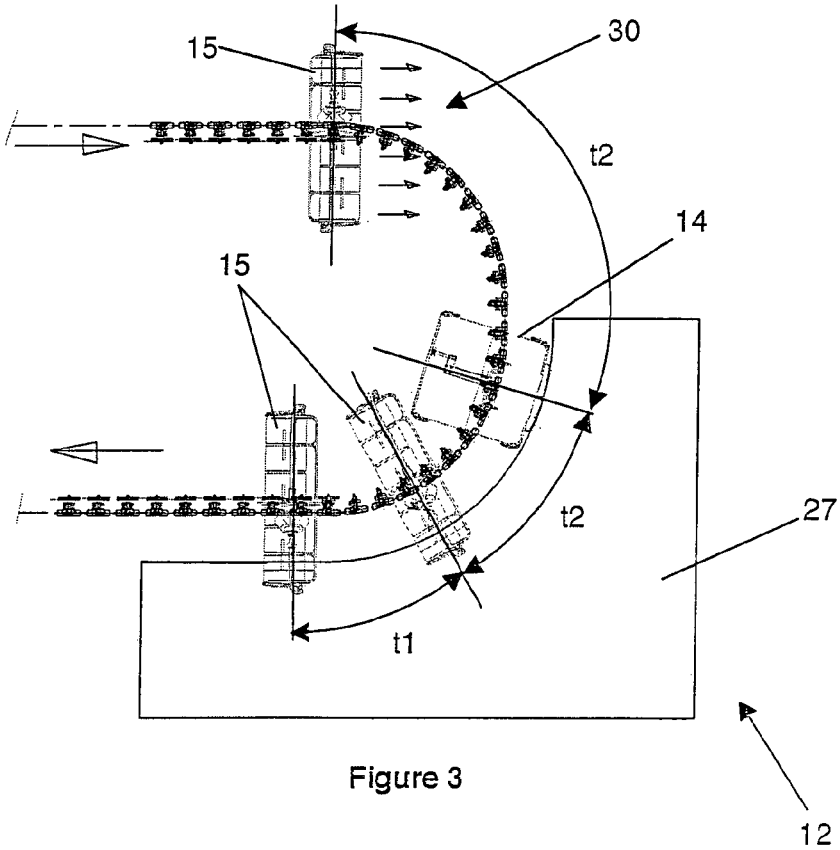
FIG. 3 is a schematic top view of a top terminal of the example of an installation.

This arrangement enables the time interval between two successive vehicles 14, 15 of the same type to be adjusted according to the physical distance necessary between two vehicles of the same type to prevent them from bumping into one another in the sections S1 and S2. It thereby becomes possible to provide successive groups of cars 14 without this considerably reducing the user throughput. The spacing combination of the vehicles 14, 15 on the aerial rope 10 can be customized at will. The cars 14 are spaced further apart from one another than the chairs 15 are. The time interval between two chairs 15 is represented by t1 in FIGS. 2 and 3. Furthermore, the time interval between a chair 15 and a car 14 is optimized to prevent them from bumping into one another in the sections S1 and S2. This time interval is represented by t2 in FIGS. 2 and 3. t1 and t2 are respectively, in the example, about 7.2 s and 8.64 s. The time interval (not represented) between two successive cars 14 is, for its part, about 12 s. In FIG. 2, it can be seen that t1 is such that the first two chairs 15 are very close to one another in the curve of the section S1. FIG. 3 illustrates that t2 is chosen in such a way that a chair 15 and a car 14 are very close to one another in the last curve of the run-through section of the loading/unloading terminal 12.

A rate regulating section S2 according to the invention enables the user throughput to be increased by optimizing the time interval between two successive vehicles 14, 15 according to the physical distance just necessary between these two vehicles 14, 15, depending on their respective type, to prevent to prevent them from bumping into one another in the sections S1 and S2. The length of the rate regulating section S2 is chosen such as to be sufficient to compensate the maximum deviations that are liable to occur. The speed associated with a vehicle 14, 15 is re-established at each passage through the rate regulating section S2.

In most cases, the distribution deviations are small and it is sufficient to equip one of the loading/unloading terminals 11, 12 with a rate regulating section S2 according to the invention, which section is preferably arranged at the arrival of the least used line 16, 17.

The invention is not limited to the described embodiment. It can be applied to different types of rate regulators, the implementation mode having to be adapted to the type of rate regulator used. The rate regulating section S2 can be arranged at any location on the transfer circuit 18. With suitable management of the memory of the control unit 31, the detection means 35 can be arranged at any point on the path of the vehicles 14, 15 anywhere in the transport installation. The run-through section C can be of any shape and can for example reproduce the teachings of French Patent applications 0501777 and 0304989 in order to increase the user throughput even further. Finally, the individual driving means of the sections delineating the sections S1 and S3 can consist of independent variable speed motors, for example controlled by the control unit 31. Mechanical driving of the vehicles 14, 15 can be performed by any other suitable means along the slowing-down section A, the speeding-up section B, and the portions delineated by the sections S1 and S3 of the driving device 21, for example by drive belts with external splines.

The invention claimed is:

1. Transport installation with a continuous running aerial rope, supporting vehicles composed of chairs and gondola cars coupled by detachable grips and staggered along the rope in a predetermined combination and with a predetermined running rate, said rope extending in a closed loop between two bull-wheels, with an up-line and a down-line, said installation having loading/unloading terminals provided at least at the ends of said lines, at least one of the loading/unloading terminals comprising:

detachment means, on entry, to detach the grips from the rope, engagement means, on exit, to recouple the grips and the rope, a transfer circuit connecting the up-line and the down-line of the rope, with a slowing-down section equipped with a slowing-down device, and a speeding-up section equipped with a propelling device, connected by a run-through section with a low running speed equipped with a driving device of the vehicles, a first location for loading/unloading into/from the cars and a second location for loading on or unloading from the chairs, staggered along the transfer circuit, and a continuous running rate regulating section arranged in the transfer circuit to perform said rate regulation of the vehicles, wherein the rate regulating section is equipped with means that is able to vary a time spent by the cars and by the chairs in said rate regulating section, to impose, on exit from the rate regulating section, at each passage of a vehicle, a time interval with respect to a previous vehicle, according to the type of said vehicle and the type of said previous vehicle:

a first time interval between said vehicle and said previous vehicle when both vehicles are chairs, a second time interval between said vehicle and said previous vehicle when both vehicles are cars, a third time interval between said vehicle and said previous vehicle when the previous vehicle is of a different type from said vehicle, said third time interval being comprised between the first and second time intervals.

2. Installation according to claim 1, wherein the driving device of the run-through section is subdivided into several successive portions able to have differential driving rates, each of said portions delineating an elemental section of the run-through section, and the rate regulating section coincides with one of said elemental sections.

3. Installation according to claim 2, wherein each portion of the driving device of the run-through section is equipped with an individual driving means of the vehicles.

4. Installation according to claim 3, wherein the rate regulating means comprise a detection means provided outside the rate regulating section and able to determine the type of vehicle entering an associated detection zone and to transmit a selection signal to a control unit able to control the individual driving means of the portion delineating the rate regulating section.

5. Installation according to claim 4, wherein the rate regulating means comprise a presence sensor arranged at a specific location along the run-through section, upline from the rate regulating section, and able to transmit a passage signal representative of passing of the vehicles to the control unit.

6. Installation according to claim 5, wherein the control unit comprises a means for counting a time elapsed between two successive passage signals.

7. Installation according to claim 4, wherein the control unit receives a clock signal synchronized with the rope so as to modulate the predetermined rates according to said clock signal.

8. Installation according to claim 4, wherein at each passage of the vehicle, the control unit controls the individual driving means of the rate regulating section according to the selection signal corresponding to said vehicle so as to modulate the time taken by said vehicle to pass through said rate regulating section to compensate for any deviation with respect to the predetermined rate associated with said vehicle.

9. Installation according to claim 8, wherein the detection means are arranged at a fixed location between the slowing-down section and the rate regulating section.

10. Installation according to claim 8, wherein the control unit comprises a memory for recording the selection signal, and the predetermined rate associated with the vehicle leaving the rate regulating section corresponds to the time interval between said vehicle and the previous vehicle, seen in the direction of movement, said interval to be obtained on exit from the rate regulating section being determined by the control unit, before said vehicle passes through the rate regulating section, according to the type of said vehicle and the type of said previous vehicle.

11. Installation according to claim 3, wherein the driving device of the run-through section comprises sets of tire-clad wheels driving the vehicles by friction, the wheels of one and the same section being driven in synchronism by the corresponding individual driving means.

12. Installation according to claim 11, wherein the wheels of the portion delineating the rate regulating section are driven by a variable speed motor.

* * * * *